US005090629A

United States Patent [19]

Pinto et al.

[11] Patent Number: 5,090,629

[45] Date of Patent: Feb. 25, 1992

[54] OPENING DEVICE

[75] Inventors: Akiva Pinto, Duesseldorf Wittlaer; Guenter LucaBen, Haltern; Reinhard Schmidt, Gescher, all of Fed. Rep. of Germany

[73] Assignee: Hergeth Hollingsworth GmbH, Dülmen, Fed. Rep. of Germany

[21] Appl. No.: 602,892

[22] Filed: Oct. 22, 1990

Related U.S. Application Data

[63] Continuation of Ser. No. 471,194, Jan. 26, 1990, abandoned.

[30] Foreign Application Priority Data

Feb. 3, 1989 [DE] Fed. Rep. of Germany ..... 3903238

[51] Int. Cl.[5] ..... D01G 7/04

[52] U.S. Cl. ..... 241/282.1; 241/101.7; 241/605; 241/285.1; 19/81

[58] Field of Search ..... 19/80 R, 80 A, 81; 241/101.7, 101 A

[56] References Cited

U.S. PATENT DOCUMENTS 4,244,082 1/1981 Leifeld et al. ..... 241/101 A X
4,623,099 11/1986 Vosbein et al. ..... 241/101.7 X
4,756,059 7/1988 Temburg ..... 19/80 R
4,796,335 1/1989 Kranefeld et al. ..... 19/80 R

FOREIGN PATENT DOCUMENTS 69847 1/1983 European Pat. Off. ..... 19/80 R
3334069 4/1985 Fed. Rep. of Germany .
2100766 1/1983 United Kingdom ..... 19/80 R

*Primary Examiner*—Mark Rosenbaum
*Attorney, Agent, or Firm*—Bailey & Hardaway

[57] ABSTRACT

In an opening device for opening pressed fibre bales, e.g. cotton and viscose staple bales and the like, comprising a plurality of opener rolls (3,4) on which a plurality of milling discs (14) are arranged side by side such that they are offset with respect to the milling discs (14) of the adjacent opener roll (3,4), and comprising a grate (10), the bars (11) of which extend between the milling discs (14), it is provided to dispose a baffle sheet (8) with a cross section of a substantially gabled roof-shape is disposed in parallel to the roll axes (6,7) of the opener rolls (3,4) between said two opener rolls (3,4), the tip of the sheet protruding beyond the grate (10) into the lower space between the opener rolls (3,4).

17 Claims, 4 Drawing Sheets

FIG. 5
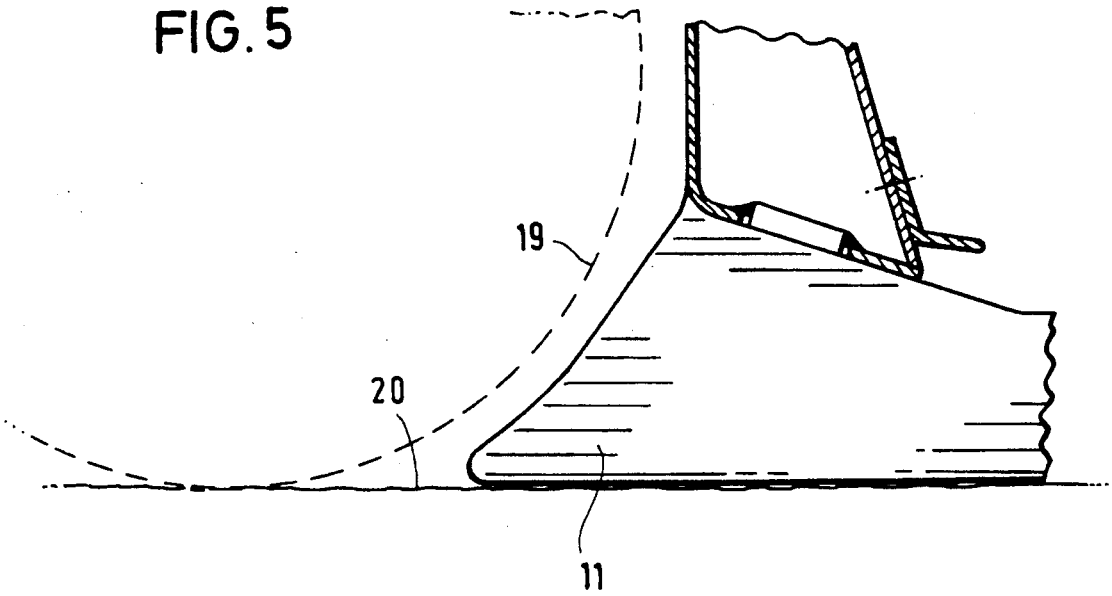
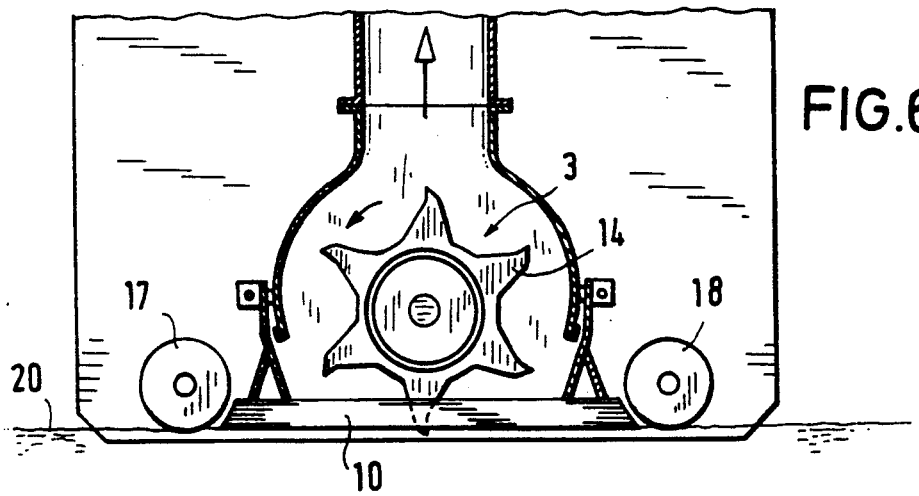
FIG.6

OPENING DEVICE

This application is a continuation of application Ser. No. 07/471,194, filed Jan. 26, 1990, now abandoned.

The invention relates to an opening device for opening pressed fibre bales, e.g. cotton and cellulose bales and the like, comprising a plurality of opener rolls on which a plurality of milling discs are arranged side by side such that they are offset with respect to the milling discs of the adjacent opener roll, and comprising a grate, the bars of which extend between the milling discs.

An opening device is known from DE-OS 33 34 069, in which the grate bars are provided with portions that, in their extension, are transversally offset with respect to the direction of movement of the opening device, at least one opener roll being provided in front of and behind the offset portion.

Further, an opening device having a pair of opener rolls is known, which has respective pressure rollers provided in front of and behind the opener rolls, a further pressure roller being disposed between the rolls. The grate bars associated with the respective opener rolls end in the center of the milling head before the central pressure roller. In this opening device, the fibre flocks loosened from the fibre bales leave the milling discs of the opener rolls tangentially on a path with a considerable horizontal component. As a result, the fibre flocks are not caught as well as they should by the suction hood disposed above the opener rolls, the more so since, travelling on their tangential path, they will hit lateral sheets of the suction hood first.

A further problem of this known opening device is that the central pressure roller quickly gets choked with fibres and winds these fibres up.

It is the object of the invention to provide an opening device in which the fibres are thrown up by the milling discs in a substantially vertical direction.

To solve the object, the present invention provides a baffle sheet with a cross section of a substantially gabled roof-shape, which is disposed between two opener rolls and parallel to the roll axes thereof, the tip of the sheet protruding into the lower space between the opener rolls.

The baffle sheet arranged between the opener rolls advantageously deflects the fibre flocks coming off the teeth of the milling discs into a substantially vertical upward direction. Thus, the fibre flocks thrown upward are prevented from hitting the lateral walls of the suction device disposed above the opener rolls, thereby advantageously maintaining the kinetic energy imparted to the fibre flocks via the milling discs. This allows operation at a lower flow velocity and, thus, at a lower consumption of air and energy.

Even a slight projection of the tip of the baffle sheet beyond the grate will suffice to achieve the desired deflection of the fibre flow.

The invention is particularly advantageous with wide milling heads (e.g. 3 m) since with such milling heads an increase of the suction flow power would be disadvantageous to the material flow.

The walls of the baffle sheet may be bent concentrically with respect to the rotational axis of the opener rolls. Such bent walls are capable of deflecting the fibre flocks that hit the baffle sheet tangentially with a minimum loss of kinetic energy, since the direction of movement of the fibre flocks has only a small normal component in the direction of the walls.

On the other hand, it may be expedient, depending on the configuration of the milling discs, to draw the tip of the baffle sheet beyond the grate up to the horizontal plane of the roll axes, at the most.

The grate bars of the grate may be mounted at the baffle sheet between two opener rolls such that the mutually offset grate bars of opposing opener rolls overlap. Thus, they can continuously depress the fibres on the surface of the bale.

In this case, the overlapping bars of the grate extend into the engaging area of the milling discs belonging to the adjacent opener roll.

It is intended in an advantageous embodiment to dispose a height-adjustable guide sheet in the milling direction before an opener roll and in parallel to the roll axes of the opener rolls. By virtue of the height-adjustable guide sheet, it is possible, e.g. with two opener rolls, to advantageously adjust the ratio between the take-off quantity of the first opener roll, seen in the milling direction, and the take-off quantity of the second opener roll. This is due to the fact that the guide sheet depresses the fibres on the bale surface more or less, depending on the height adjustment, so that this allows a presetting of the take-off quantity of the first opener roll in the milling direction. Prior to reaching the second opener roll, seen in the milling direction, the fibres on the bale surface, due to the elastic restoring capacity of the fibres, have rectified themselves sufficiently to permit the second opener roll to take off a certain quantity.

Preferably, the grate bars are elongated immediately up to pressure rollers disposed in the advancing direction in front of the milling discs. In this way, the bale surface is continuously pressed down by the front pressure roller from the area of the milling head up to the rear pressure roller.

The following is a detailed description of embodiments of the present invention taken in conjunction with the accompanying drawings.

In the Figures

FIG. 5 is a further example of the configuration of the grate bar ends, and FIG. 6 a further embodiment of the grate in an opening device with an opener roll.

Figure 1:
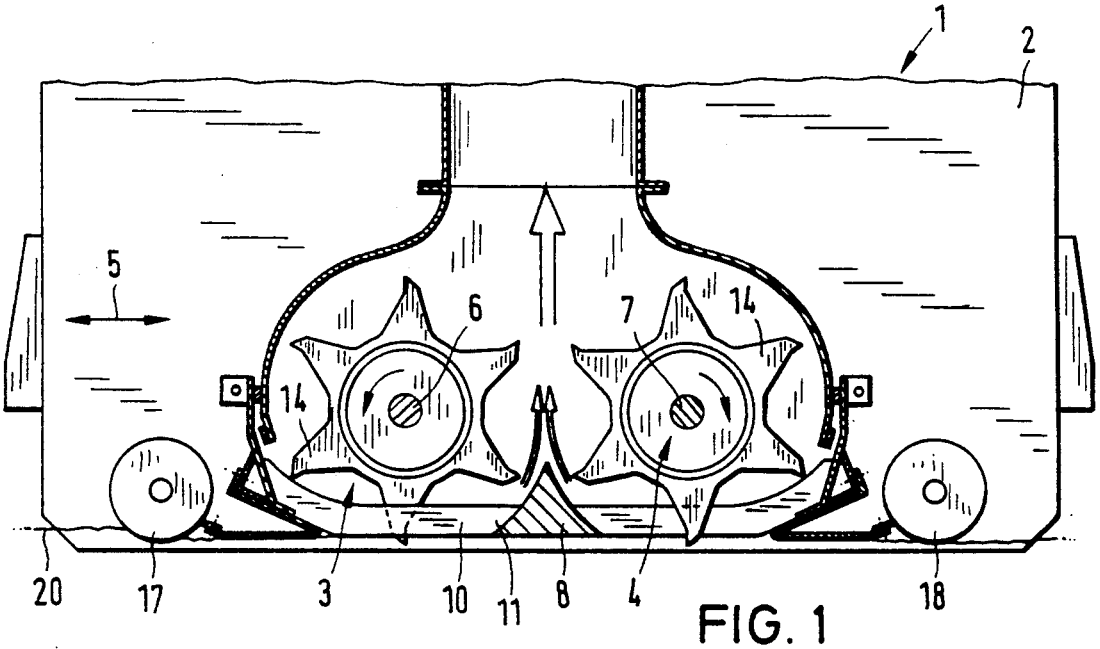
FIG. 1 is a portion of a milling head casing of an opening device.

The opening device 1 for opening pressed fibre bales and the like is provided with a casing 2 in which a pair of opener rolls 3 and 4 are arranged behind one another in the direction of movement as indicated by the arrow 5. The opener rolls 3 and 4 are supported by axes 6 and 7 connected with driving devices. The opener rolls have milling discs 14 that are axially arranged in a predetermined distance from each other. The opener rolls 3, 4 cooperate with a grate 10 composed of an array of grate bars 11 being spaced from each other in a predetermined distance. The grate bars 11 are mounted on a mount 12 so as to be height-adjustable.

Like the milling discs of the adjacent opener rolls 3,4, the grate bars are arranged mutually offset.

Figure 2:
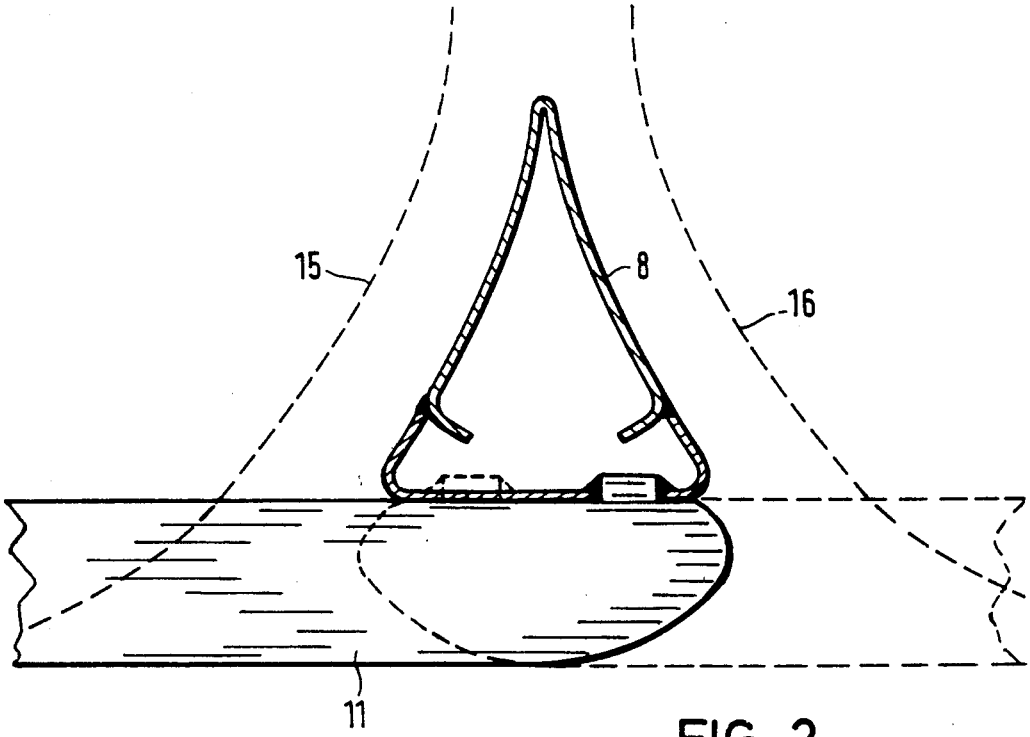
FIG. 2 is an enlarged portion of FIG. 1.

In the middle between the two opener rolls 3, 4, a baffle sheet 8 extends in parallel to the roll axes 6, 7 over the entire length of the milling head, the substantially triangular sectional shape of the baffle sheet being illustrated in FIGS. 1 and 2. The baffle sheet 8 substantially consists of two gabled roof-shaped walls that are curved in cross section. The respective circular arcs are concentric to the roll axes 6, 7 and extend in parallel to the lines of action 15, 16 of the adjacent milling discs 14 on the roll axes 6 and 7. As illustrated in FIG. 2, the guide sheet 8 may be mounted on the grate bars 11 of the grate 10 or, as indicated in FIG. 1, it may be connected with the grate bars 11 such that these are welded to the wall surfaces. It is also possible to arrange the baffle sheet 8 between two adjacent grate bars 11 and to secure it at the grate bars.

The tip of the baffle sheet 8 may be drawn up to the horizontal plane of both roll axes 6, 7, a projection of 1 cm beyond the grate 10 being possibly sufficient, however, to deflect the fibre flocks thrown off the milling discs 14 into a substantially vertical upward direction.

Figure 3:
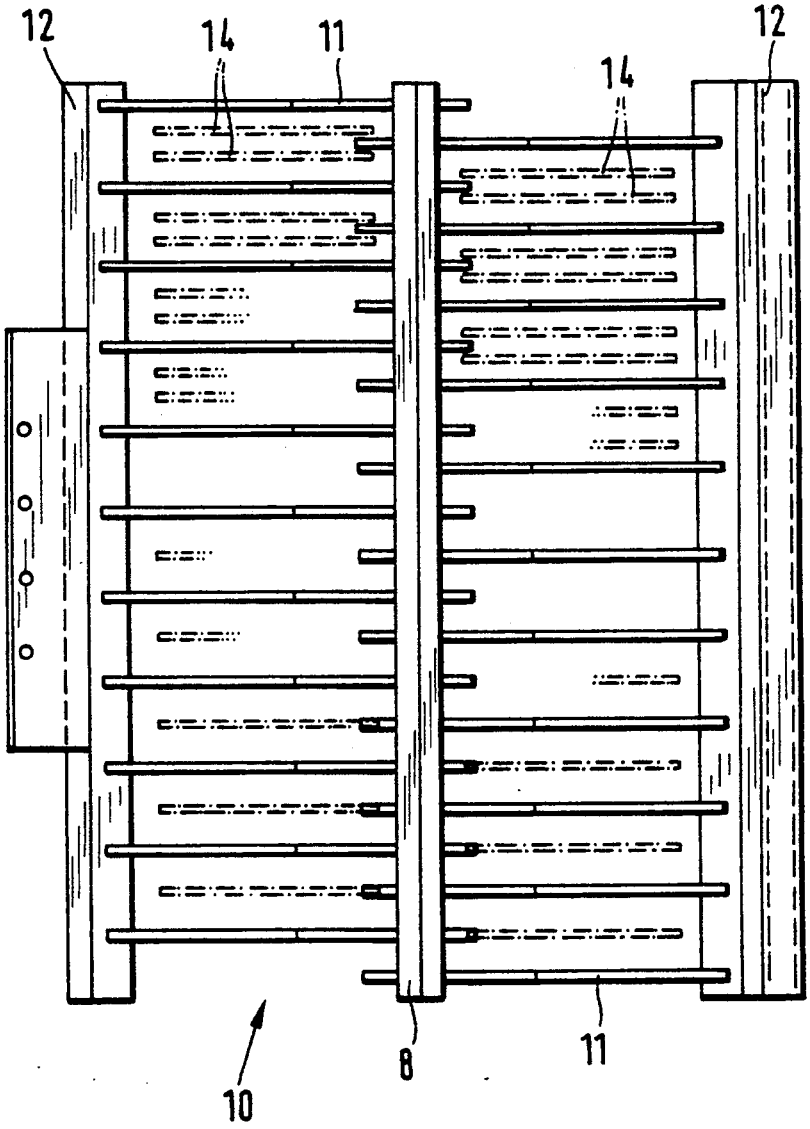
FIG. 3 is a top plan view of an embodiment of the grate.

As can be seen from FIG. 3, the grate bars 11 are preferably projected beyond the centre line between the two roll axes 6, 7 into the zone of action of the milling discs 14 of the adjacent roll axis in order to press the bale surface down as far as possible. Depending on the space between the two roll axes, this is achieved already, as shown in FIG. 2, if the grate bars 11 are mounted on the guide sheet 8, provided that the circles of action 15, 16 of the milling discs 14 are sufficiently close to one another. It is essential in this regard that the grate bars overlap in the intermediate zone between the two groups of milling discs so that a continuous depressing function is guaranteed.

The preferably star-shaped milling discs 14 are preferably rotated synchroneously in opposite directions, the phase relation of the teeth optionally being synchronized, too. In the case of the opposite offset milling discs 14, it may also be provided that the lines of action 15, 16 overlap.

The overlapped configuration of the centrally oriented ends of the grate bars 11 does not depend on whether single milling discs 14, as shown in the lower part of FIG. 3, or pairs of milling discs, as shown in the upper part of FIG. 3, are used.

Figure 4:
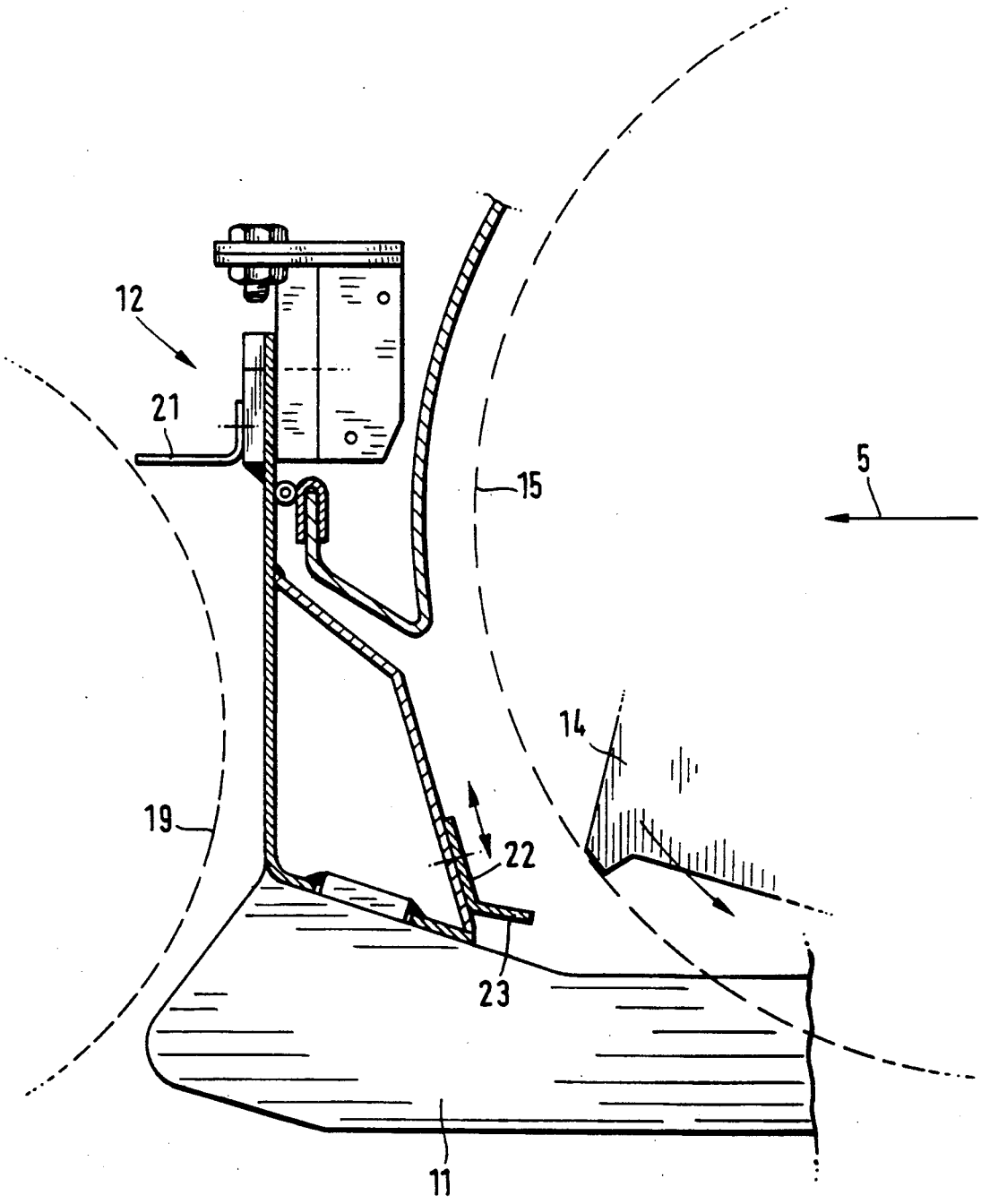
FIG. 4 is the configuration of the grate between pressure roller and opener roll.

A skid-shaped configuration of the ends of the grate bars 11, as illustrated in FIG. 4, is advantageous for reliably preventing a hooking with the fibers. FIG. 5 illustrates a further embodiment of the configuration of the ends of the grate bars 11 wherein the lower edge of the grate bars 11 extends linearly toward pressure roller 17 and terminates just short of the line of action 19 of the pressure roller 17, leaving a small space therebetween.

As can be seen from FIG. 1, a respective pressure roller 17,18 is arranged in the direction of movement in front of and behind the opener rolls 3, 4. FIG. 4 illustrates grate bars 11 that are positioned adjacent the pressure roller 17, in close proximity to the line of action 19 of the pressure roller. A similar arrangement with the pressure roller 18 at an end of casing 2 opposite pressure roller 17, allows a continuous flawless pressing of the bale surface 20 in the entire region of the milling head. In this zone, the grate bars 11 are height-adjustably mounted on the mount 12 which may also be provided with an air dust seal 21. The mount 12 may further be provided with an angled guide sheet 22, height-adjustably mounted thereon and extending over the entire length of the milling head. The angled portion 23 of the guide sheet 22 presses the bale surface in parallel to the roll axes over the entire width of the bale and compresses it for a short time, depending on the setting. In doing so, the take-off quantity of the milling discs 14 of the first opener roll 3, seen in the direction of movement 5, is set by means of this guide sheet 22. Since the fibres on the bale surface, due to their elasticity, will stand up in a comparatively short time, the milling discs 14 of the subsequent opener roll 4, seen in the direction of movement 5, can also take off a layer of the bale depending on the first take-off quantity.

FIG. 6 illustrates an embodiment of an opening device with only one opener roll 3. As in the embodiment of FIGS. 4 and 5, the grate bars 11 extend immediately to the engaging range 19 of the pressure rolls 17, 18.

What is claimed is:

1. In a device for opening pressed fibre bales having a plurality of opener rolls an which a plurality of milling discs are arranged in side by side relation such that milling discs are offset with respect to milling discs of an adjacent opener roll, and including a grate having bars which extend between the milling discs, the improvement comprising:

a baffle sheet, having a substantially gabled roof-shaped cross section with two upwardly extending walls joining to form a tip of said baffle sheet, disposed in parallel relation to the axes of the opener rolls between said opener rolls, the tip of the sheet protruding between the opener rolls for deflecting loosened fibers in a vertical direction.

2. The structure set forth in claim 1 wherein the walls of said baffle sheet are curved concentrically to the rotational axis of the opener rolls.

3. The structure set forth in claim 1 wherein the tip of said baffle sheet extends beyond the grate up to the horizontal plane through the roll axes.

4. The structure set forth in claim 1 wherein the grate bars are mounted adjacent said baffle sheet between two opener rolls such that mutually offset grate bars associated with the respective opener rolls overlap each other.

5. In a device for opening pressed fibre bales having a plurality of opener rolls on which a plurality of milling discs are arranged in side by side relation such that milling discs are offset with respect to milling discs of an adjacent opener roll, and including a grate having bars which extend between the milling discs, the improvement comprising:

a baffle sheet having a substantially gabled roof-shaped cross section with two upwardly extending walls joining to form a tip of said baffle sheet, disposed in parallel relation to the axes of the opener rolls between said opener rolls, wherein the walls of said baffle sheet are curved concentrically to the rotational axes of said opener rolls, with the tip of said sheet protruding between said opener rolls and extending beyond said grate up to the horizontal plane through said rotational axes for deflecting loosened fibers in a vertical direction; and wherein a first height-adjustable guide sheet is disposed in front of an opener roll in the milling direction, parallel to the axes of the opener rolls and an opposite second adjustable guide sheet is disposed behind another opener roll, said guide sheets supported by said grate.

6. The structure set forth in claim 5 wherein said guide sheets are mounted adjacent said grate and a grate mount.

7. The structure set forth in claim 6 wherein said guide sheets are inclined at an angle of about 5° to 20° in the feed direction such that said guide sheets press the bale surface down to a lower horizontal plane, when the opener rolls are moved in the feed direction.

8. The structure set forth in claim 1, wherein said grate bars are projected adjacent pressure rollers and extend between said opener rolls.

9. The structure set forth in claim 8, wherein a lower edge of said grate bars extends linearly to said pressure rollers.

10. In a device for opening pressed fibre bales having a plurality of opener rolls on which a plurality of milling discs are arranged in side by side relation such that milling discs are offset with respect to milling discs of an adjacent opener roll, and including a grate having bars which extend between the milling discs, the improvement comprising:

grate bars between opener rolls mounted adjacent two oppositely attached guide sheets extending parallel to the axes of said opener rolls, such that mutually offset grate bars associate with different overlapping opener rolls, said opener rolls being capable of removing successive layers of said bales in a controlled fashion.

11. The structure set forth in claim 10 wherein said grate bars are projected to pressure rollers arranged in the feed direction in front of the opener rolls.

12. The structure set forth in claim 11, wherein lower edges of said grate bars extend linearly to the pressure rollers.

13. In a device for opening pressed fibre bales having a plurality of opener rolls on which a plurality of milling discs are arranged in side by side relation such that milling discs are offset with respect to milling discs of an adjacent opener roll, and including a grate having bars which extend between the milling discs, the improvement comprising:

first and second height-adjustable guide sheets, said first guide sheet disposed in front of an opener roll in the feed direction and a second guide sheet behind an opener roll opposite the feed direction, said first and second guide sheets being parallel to the axes of the opener rolls.

14. The structure set forth in claim 13 wherein said guide sheets are mounted at said grate.

15. The structure set forth in claim 14 wherein said first and second height-adjustable guide sheets are arranged at an angle such that said guide sheets open in the feed direction of the opener rolls and increasingly press down the bale surface.

16. The structure set forth in claim 15 wherein said first and second guide sheets are mounted at corresponding grate mounts.

17. In a device for opening pressed fibre bales having an opener roll provided with milling devices and a grate having bars which extend adjacent the milling discs, the improvement comprising:

said grate bars being pronged adjacent pressure rollers arranged in front of the opener roll in the feed direction, a lower edge of each of said grate bars extending linearly toward a corresponding pressure roller and terminating proximate a line of action of said corresponding pressure roller, with the ends of each of said grate bars being skid-shaped to prevent hooking of fibers.

* * * * *